US009350474B2

(12) United States Patent
Mareci

(10) Patent No.: US 9,350,474 B2
(45) Date of Patent: May 24, 2016

(54) DIGITAL AUDIO ROUTING SYSTEM

(71) Applicant: William Mareci, Hollywood, CA (US)

(72) Inventor: William Mareci, Hollywood, CA (US)

( * ) Notice: Subject to any disclaimer, the term of this patent is extended or adjusted under 35 U.S.C. 154(b) by 499 days.

(21) Appl. No.: 13/862,993

(22) Filed: Apr. 15, 2013

(65) Prior Publication Data

US 2014/0307893 A1 Oct. 16, 2014

(51) Int. Cl.
*H04H 60/07* (2008.01)
*H04H 20/89* (2008.01)

(52) U.S. Cl.
CPC ..... *H04H 60/07* (2013.01); *H04H 20/89* (2013.01); *H04S 2400/01* (2013.01); *H04S 2400/05* (2013.01); *H04S 2400/13* (2013.01)

(58) Field of Classification Search
CPC ... H04R 3/12; H04S 2400/05; H04S 2400/13; H04S 2400/01; H04H 60/07; H04H 20/89
See application file for complete search history.

(56) References Cited

U.S. PATENT DOCUMENTS 5,233,477 A * 8/1993 Scheffler ..... 360/15
5,619,197 A * 4/1997 Nakamura ..... 341/50
5,646,931 A * 7/1997 Terasaki ..... 369/124.08
6,278,784 B1 * 8/2001 Ledermann ..... 381/58
6,311,155 B1 * 10/2001 Vaudrey et al. ..... 704/225
7,606,716 B2 10/2009 Kraemer
2002/0161579 A1 * 10/2002 Saindon et al. ..... 704/235
2007/0027682 A1 * 2/2007 Bennett ..... 704/215
2008/0015867 A1 1/2008 Kraemer
2008/0037151 A1 * 2/2008 Fujimoto et al. ..... 360/18

* cited by examiner

*Primary Examiner* — Ping Lee
(74) *Attorney, Agent, or Firm* — Mercedes V. O'Connor

(57) ABSTRACT

A digital audio routing system providing a process and system for managing multi-channel audio signals and a plurality of language signals, and decoding the signals into serial sound data to create a program serial data and a plurality of language serial data. The program serial data and the plurality of language serial data are aligned, and the program serial data is separated. The plurality of language serial data are separated to create a plurality of language channels. At least one language channel is mixed with at least one serial data to generate a language channel mix. The levels of each program serial data and language channel mix are adjusted to generate a final output mix. The final output mix is encoded to adhere to the AES-3id standard to create an output signal, and the output signal is then transmitted.

14 Claims, 6 Drawing Sheets

Surround Sound Mode Operation

101
Start

Stereo Mode Operation
103
Receive Audio Signal
105
Decode
Program Data
Language Data
107
Align
109
Separate Program Data
Adjust Levels
121
Separate Language Data
111
122
Left
Right
L
L+1
...
L+8
112
Mono to Stereo Split
116
114
Mix Language/ Program Data
118
Left Langauge
Right Language
Adjust Levels
115
120
117
Encode
119
Transmit Audio Mixer Oscillator Tone Audio Data System Apparatus Mono Sound Mode

DIGITAL AUDIO ROUTING SYSTEM

BACKGROUND OF THE INVENTION

1. Field of the Invention

The present invention relates to the field of multi-channel audio transmission and methods of selecting and manipulation of a plurality of language options for a multi-channel audio transmission.

2. Description of the Related Art

Technological advancement in the audio industry has expanded beyond stereo systems with a left and right channel. These stereo systems have now been replaced by multi-channel surround sound systems. A typical surround sound system will often include a center channel, at least one right channel, at least one left channel, one right surround sound channel, and one left surround sound channel. The surround sound channels are typically placed behind the user to provide a 360 degree sound experience. Surround sound systems can also include a low frequency effects (LFE) channel to generate low frequency sound effects.

Surround sound configurations can have a varying number of channels. For example, a 5.1 surround sound system will include a center channel, a left channel, a right channel, a left surround sound channel, a right surround sound channel, and a LFE channel. In contrast, a 7.1 system includes all the channels found in the 5.1 system and an additional left and right channel. The extra two channels allow the user to have a more rounded listening experience.

In addition to the audio industry, technological advancement has also allowed the world to become a much smaller place. It is not uncommon for a family in the United States to be watching a Japanese reality show or for a family in Denmark to be watching a French soap opera. This has created an increased need to for broadcasters to provide multiple language transmissions for the same programming. Sporting events such as the Olympics and the World Cup are viewed in a hundred different languages all across the world. Viewers often will only be able to receive one language and often it is the native language of the region and not the preferred language of the local viewer.

For broadcast stations to adapt programming to the local language, the process requires large digital consoles, digital to analog convertors, analog to digital convertors, analog mixers, and the expertise of a mix engineer. Performing these functions can be highly costly in terms of time, equipment space, and sound quality. It is common in the industry of broadcast transmission to provide a secondary audio programming (SAP) that allows the user to select a second predetermined audio language. One drawback to SAP programming is it is often limited to a monaural audio signal. So a user desiring the second language will sacrifice the ability to experience the multi-channel experience provided by the native language programming. Even in the native language, the audio signal received is not always at ideal sound levels. Many times, broadcast stations need the option to adjust the sound levels of the signal without the need to change the language.

There is a need for a simpler method for broadcast stations to change the language options of the programming and to adjust the levels of the sound mix without the added expense of time, equipment space, and sound quality.

SUMMARY OF THE INVENTION

The present invention provides a process and system for managing multi-channel audio signals and a plurality of language signals, and decoding the signals into serial sound data to create a program serial data and a plurality of language serial data. The program serial data and the plurality of language serial data are aligned, and the program serial data is separated. The plurality of language serial data are separated to create a plurality of language channels. At least one language channel is mixed with at least one serial data to generate a language channel mix. The levels of each program serial data and language channel mix are adjusted to generate a final output mix. The final output mix is encoded to adhere to the AES-3id standard to create an output signal, and the output signal is then transmitted.

DETAILED DESCRIPTION OF THE PREFERRED EMBODIMENT

Figure 1:
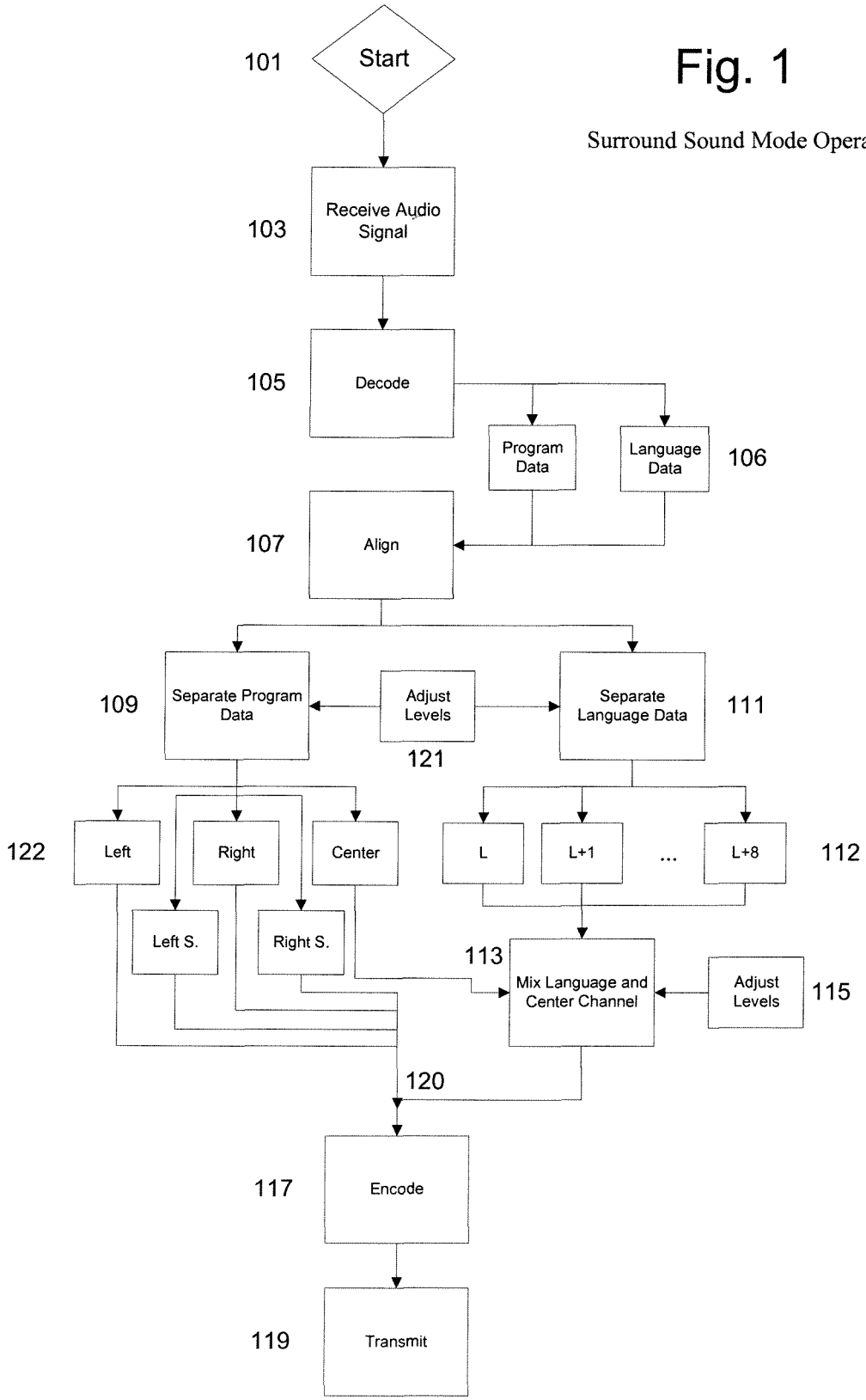
FIG. 1 is a high level block diagram of a surround sound mode of a digital audio routing system according to an embodiment of the present invention.

Reference will now be made to the drawings wherein like reference designators refer to like components or processes throughout. FIG. 1 is a high level block diagram of a surround sound mode of a digital audio routing system adapted to provide a broadcaster with the ability to transmit different dialog options to a user.

In the surround sound embodiment illustrated in FIG. 1, the system comprises the steps of receiving an incoming surround sound signal 103 from a remote broadcast 101. A transceiver 501 (FIG. 5) can be used as a receiver and transmitter for all audio signals. The signal 103 will follow the AES-3id standard which uses the same cabling, patching, and infrastructure as analogue or digital video, and is thus common in the broadcast industry. The AES-3id standard uses 75-ohm BNC electrical pair connections to enter the receiver. In the illustrated embodiment, the transceiver 501 will accept seven AES pair connections, three AES pairs for the audio inputs and four AES pairs for the language inputs. Once the signal 103 is received, transceiver 501 (FIG. 5) will decode 105 the AES-3id signals into Integrated Interchip Sound (IIS) serial data interface. IIS is an electrical serial bus interface standard used for connecting integrated circuits in an electronic device. The decoded signals 105 will contain separate 106 program serial data and language serial data as shown in FIG. 1.

Figure 5:
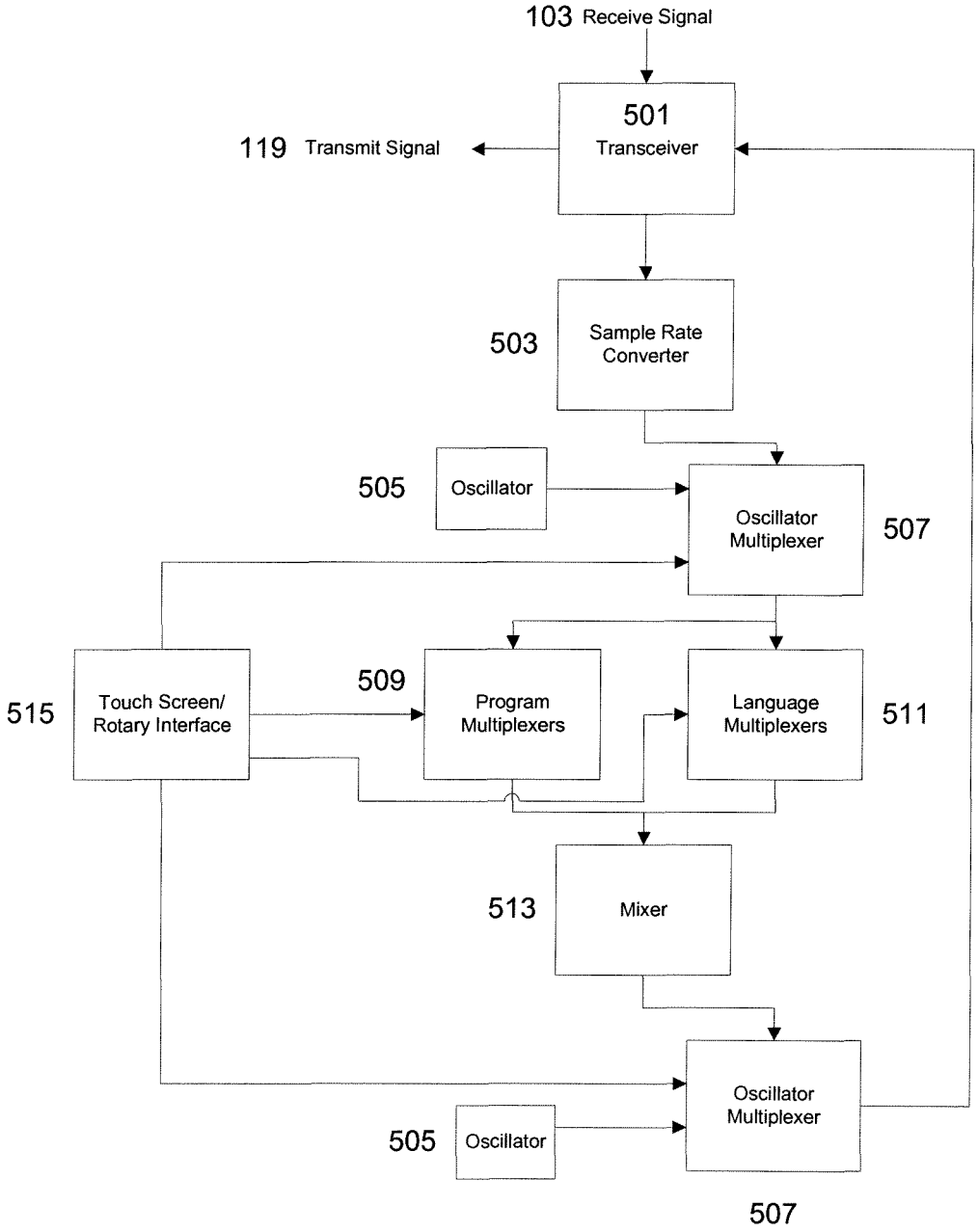
FIG. 5 is a block diagram of the components in a digital audio routing system configured in accordance with the present invention.

The program serial data and language serial data will be aligned 107 to a master clock using a sample rate converter 503 (FIG. 5). This step synchronizes all the audio signals. Synchronization is necessary because not all signals use the same sampling rates. For example, American television (48 kHz), European television (44.1 kHz), and movies (48 kHz or 96 kHz) all use different sampling rates. Just replaying the existing data at the new rate will not normally work, since it introduces large changes in pitch for audio, plus it cannot be done in real time. In the broadcast industry, separate devices in a broadcast studio function at different sample rates. Additionally, the sample rates may be the same, but there may be timing differences between devices. Examples of the devices include but are not limited to CD players, tape machines, computers, and asynchronous satellites. The sample rate converter 503 (FIG. 5) can change the sampling rate while changing the information carried by the signal as little as possible.

Figure 4:
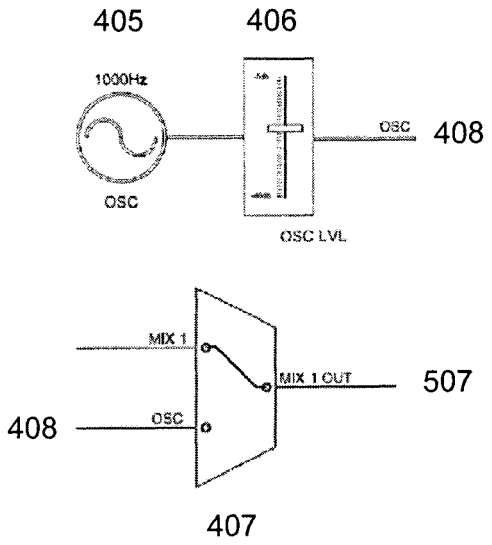
FIG. 4 is a graphical illustration of the oscillator tone generator in the digital audio routing system of the present invention.

Once aligned, the program data and language data can be injected with an oscillator tone (FIG. 4) using an oscillator 405, equalizer 406, and an oscillator multiplexer 407. The oscillator tone 408 is used for testing purposes. The oscillator tone (FIG. 4) is injected to allow a broadcast engineer to confirm the routing path of the data and verify that a signal is being received. The program data and language data will then be separated 109/111 (FIG. 1). In surround sound mode shown in FIG. 1, the program data is separated into a center speaker channel, left speaker channel, right speaker channel, left surround speaker channel, and right surround speaker channel 122. In the stereo mode of FIG. 2, the program data will separate 109 to a left speaker channel and a right speaker channel 122. The language data will be separated 111 into a maximum of eight different language channels 112. A plurality of audio multiplexers 509 and language multiplexers 511 (FIG. 5) will select the inputs to be sent to a plurality of mixers 513. There is one mixer 513 for each separate language channel 112 (FIG. 1).

Each mixer 513 (FIG. 3) will have three signal inputs, the desired broadcast language 301, the original native language 303, and the auxiliary signal 305, as well as individual level controls 300. The mixer 513 will combine signals to create a language channel mix 307. In surround sound mode FIG. 1, the center speaker channel is used in the mixer 513. In stereo mode FIG. 2, both the left speaker channel and the right speaker channel 122 will process through the mixer 114. In certain embodiments, the auxiliary signal 305 (FIG. 3) may contain dialog placed on top of the original language dialog. This may include narration from varied viewpoints such as color commentary, play by play perspective, or additional dialog separate from the original signal. For example, in one embodiment, the auxiliary signal 305 can allow the broadcaster to say "up next on the local news" during the credits of a television show. After each mixer 513, the signal again goes through an oscillator 505 and multiplexer 507 (FIG. 5) for testing/signal verification purposes. The language channel mix 307 (FIG. 3) is added with the program channels 122 (FIG. 1) to create a final output mix 120 which is sent to be encoded 117.

The levels of the language channel mix 307 (FIG. 3) are adjusted 115 via a touch screen interface 515 (FIG. 5), rotary interface, or remote ethernet interface. The ethernet interface allows parameter adjustment over a computer network. The interface can also adjust the levels of the program data and language data 121 when each is separated 109/111. The language channel mix 307 (FIG. 3) is added with the program channels 122 (FIG. 1) to create a final output mix 120 which is sent to be encoded 117.

Figure 2:
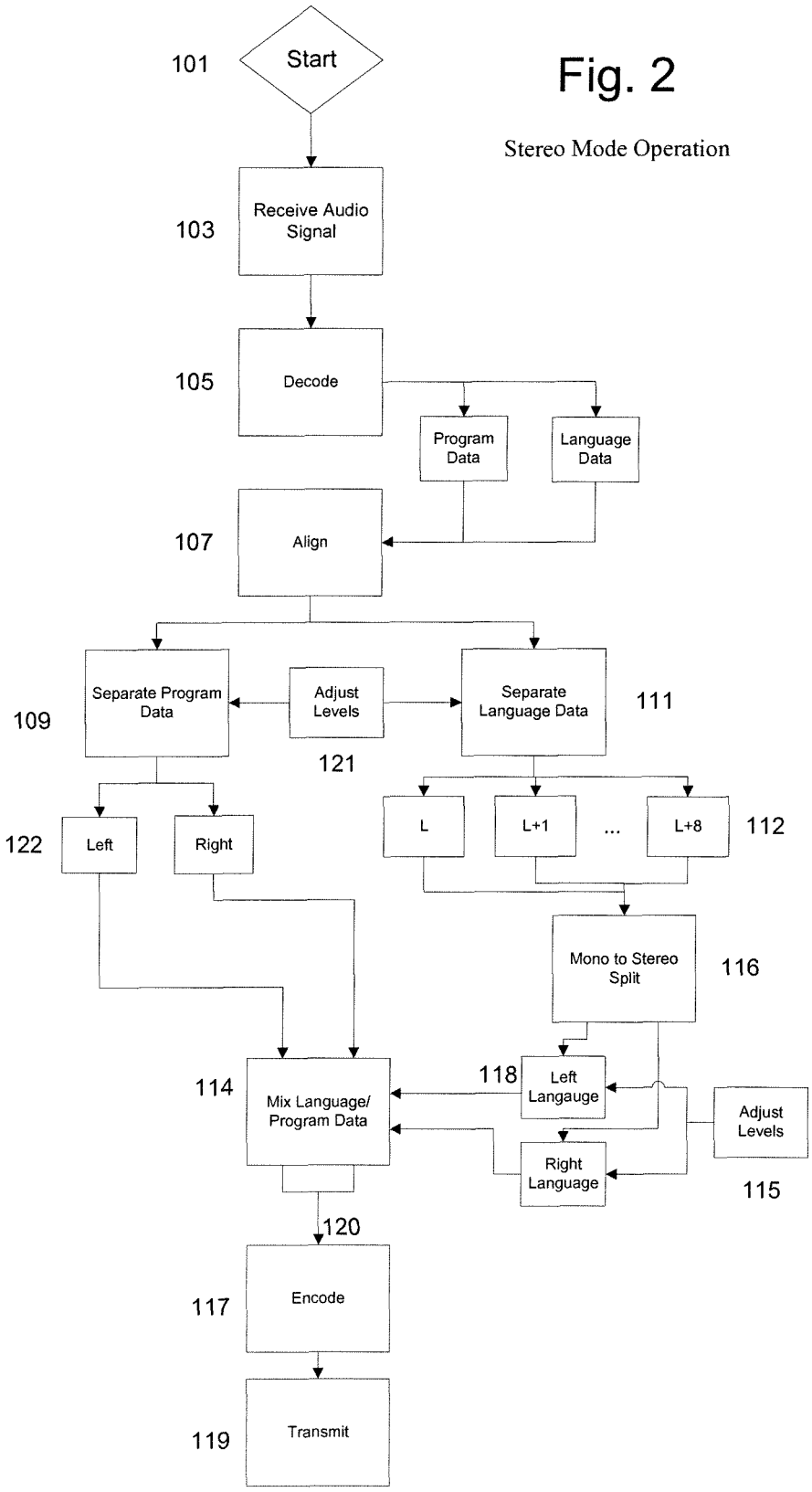
FIG. 2 is a high level block diagram of another stereo sound mode of a digital audio routing system according to an embodiment of the present invention.
Figure 3:
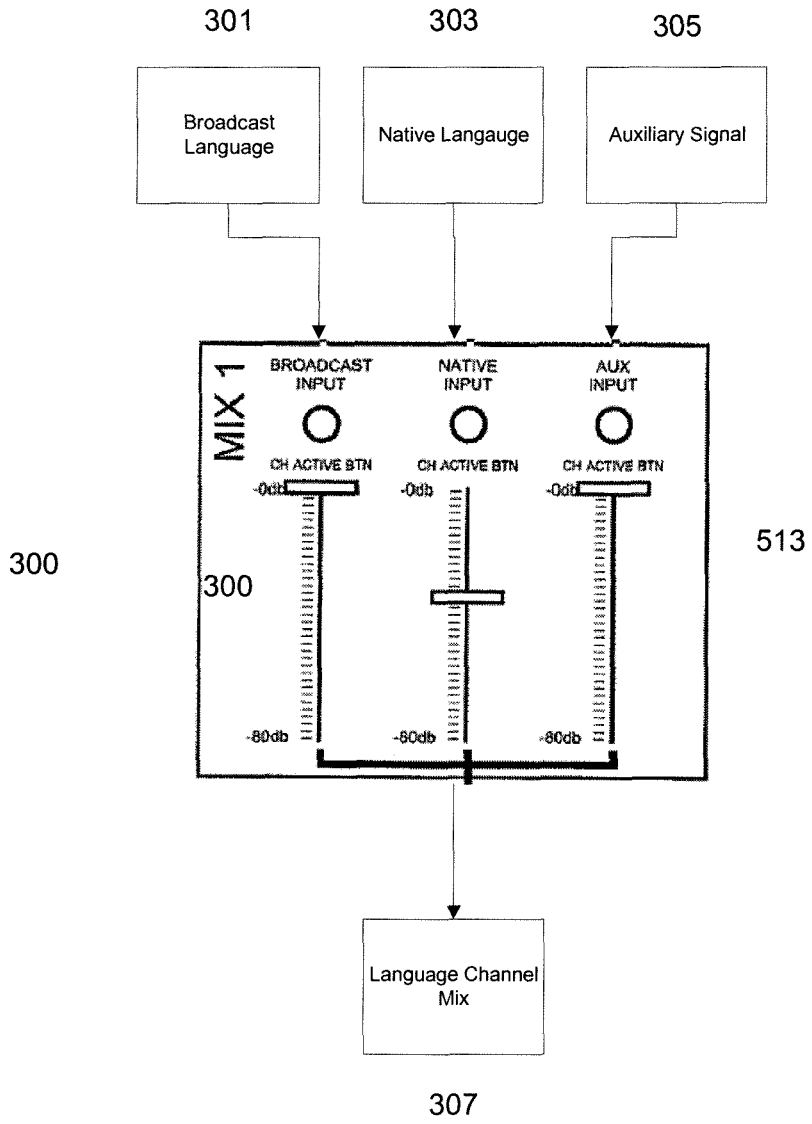
FIG. 3 is a graphical illustration of the audio mixer in the digital audio routing system of FIGS. 1 and 2.

In the FIG. 2 embodiment of the stereo mode of operation, the program separation step 109 into left and right channels 122 takes place simultaneously with the separation 111 of the language signals. The language channels 112 go through a mono to stereo split 116. The mono to stereo split 116 will divide each language channel 112 into a left language channel and a right language channel 118. Once the levels of the left channel and right channel 118 are adjusted 115, the left language channel and the right language channel 118 are sent to the mixer 513 (FIG. 5) for the step of combining the signals. Accordingly, the left channel 122 is mixed with the left language channel 118 and the right channel 122 is mixed with the right language channel 118 to create a left channel mix and a right channel mix 114 of the program and language signals. The left channel mix and right channel mix 114 are added together to create the final output mix 120 which will be sent to be encoded 117.

Figure 6:
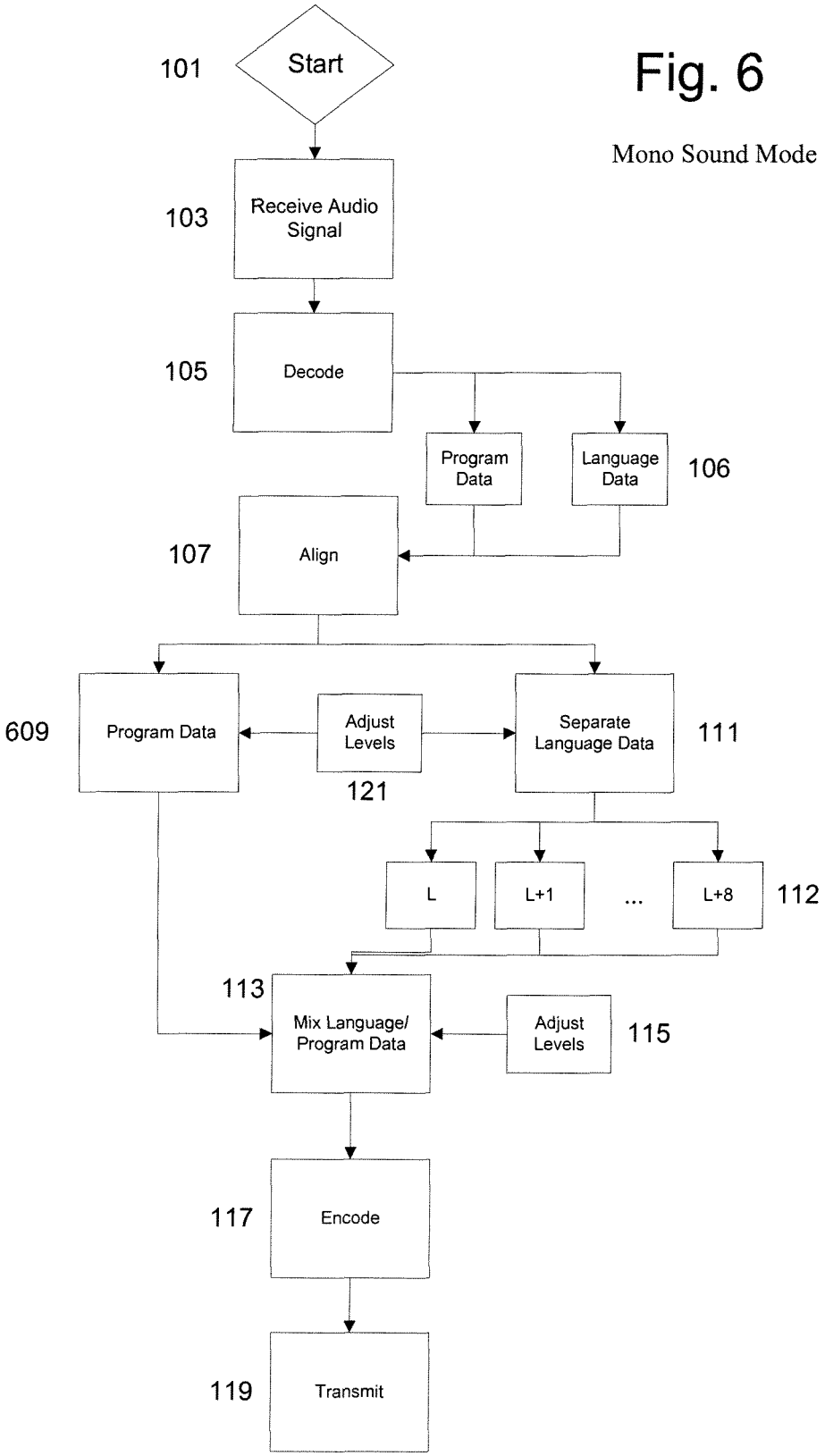
FIG. 6 is a high level block diagram of another mono sound mode of a digital audio routing system according to an embodiment of the present invention.

In the FIG. 6 embodiment of the mono sound mode of operation, the program serial data 609 is mixed with at least one language channel 112 to form an output mix 120 which will be sent to be encoded 117.

Once the final output mix is encoded back to the AES-3id standard 117 (FIGS. 1, 2), the mix is sent back to the transceiver 501 (FIG. 5) to be transmitted 119 to the appropriate location.

What is claimed:

1. A process for managing multi-channel audio data, the process comprising the steps of:

receiving a multi-channel audio signal;

decoding the multi-channel audio signal into program serial data and language serial data, the language serial data comprising an original broadcast language;

aligning the program serial data and the language serial data into aligned data, the aligned data aligned to a master clock;

separating the aligned data into program data and language data;

separating the program data into a center speaker channel, a left speaker channel, a right speaker channel, a left surround speaker channel, and a right surround speaker channel;

separating the language data into at least one language channel;

mixing the original broadcast language, the at least one language channel, and the center speaker channel into a language channel mix;

combining the language channel mix, the left speaker channel, the right speaker channel, the left surround speaker channel, and the right surround speaker channel into a final output mix;

encoding the final output mix to create an output signal; and transmitting the output signal.

2. The process of claim 1, further comprising separating the program serial data.

3. The process of claim 2 wherein:

separating the program serial data occurs after aligning the program serial data and the plurality of language serial data.

4. The process of claim 1, wherein:

separating the program serial data occurs prior to mixing the at least one language channel.

5. The process of claim 1, further comprising the step of:

adjusting the levels of at least one of the program serial data and the at least one language channel.

6. The process of claim 1, wherein:

encoding the final output mix complies with the Audio Engineering Society 3id standard.

7. The process of claim 1, wherein decoding the multi-channel audio signal into program serial data and language serial complies with the Integrated Interchip Sound serial data interface standard.

8. The process of claim 1, further comprising generating an oscillator testing tone.

9. A multi-channel audio data system comprising:

a transceiver for receiving a multi-channel audio signal, for decoding the multi-channel audio signal into program serial data and language serial data, for encoding a final output mix into a final output signal, and for transmitting the final output signal;

a sample rate converter to align the program serial data and the language serial data into aligned data, the aligned data aligned to a master clock;

a multiplexer for selecting program channel data from the aligned data and sending the program channel data to an audio multiplexer and for selecting the language channel data from the aligned data and sending the language channel data to a language multiplexer to generate a desired broadcast language signal;

a user interface for adjusting the levels of the program channel data or the language channel data;

a language mixer for combining an original broadcast language signal, the desired broadcast language signal, an auxiliary signal, and level controls to generate a language channel mix; and an output mixer for combining the program channel data with the language channel mix to generate the final output mix.

10. The multi-channel audio data system of claim 9, further comprising:

an adjuster for altering the levels of the program serial data or the language serial data.

11. A process for managing multi-channel audio data, the process comprising the steps of:

receiving a multi-channel audio signal from a remote broadcast;

decoding the multi-channel audio signal into program serial data and language serial data, the language serial data comprising an original broadcast language;

aligning the program serial data and the language serial data into aligned data, the aligned data aligned to a master clock;

separating the aligned data into program data and language data;

separating the program data into a left speaker channel and a right speaker channel;

separating the language data into at least one language channel;

separating the at least one language channel into a left language channel and a right language channel;

mixing the left language channel and the left speaker channel into a left channel mix;

mixing the right language channel and the right speaker channel into a right channel mix;

combining the left channel mix and the right channel mix into a final output mix;

encoding the final output mix to create an output signal; and transmitting the output signal.

12. A process for managing multi-channel audio data, the process comprising the steps of:

receiving a multi-channel audio signal from a remote broadcast;

decoding the multi-channel audio signal into program serial data and language serial data, the language serial data comprising an original broadcast language;

aligning the program serial data and the language serial data into aligned data, the aligned data aligned to a master clock;

separating the aligned data into program data and language data;

separating the language data into at least one language channel;

combining the at least one language channel and the program data into a final output mix;

encoding the final output mix to create an output signal; and transmitting the output signal.

13. The process of claim 11, further comprising the step of:

adjusting the levels of at least one of the program serial data and the at least one language channel.

14. The process of claim 13, further comprising the step of:

adjusting the levels of at least one of the program serial data and the at least one language channel.

* * * * *